US009260233B2

(12) United States Patent
Jones et al.

(10) Patent No.: US 9,260,233 B2
(45) Date of Patent: Feb. 16, 2016

(54) FORMULATIONS

(71) Applicants: Brian Jones, Knowsley (GB); John Pickles, Knowsley (GB); Harry Baker, Knowsley (GB)

(72) Inventors: Brian Jones, Knowsley (GB); John Pickles, Knowsley (GB); Harry Baker, Knowsley (GB)

(73) Assignee: COLORMATRIX HOLDINGS, INC., Wilmington, DE (US)

( * ) Notice: Subject to any disclaimer, the term of this patent is extended or adjusted under 35 U.S.C. 154(b) by 79 days.

(21) Appl. No.: 13/833,710

(22) Filed: Mar. 15, 2013

(65) Prior Publication Data

US 2014/0224679 A1 Aug. 14, 2014

Related U.S. Application Data

(60) Provisional application No. 61/762,483, filed on Feb. 8, 2013.

(51) Int. Cl.

| | |
|---|---|
| ***B65D 25/08*** | (2006.01) |
| ***B65D 77/06*** | (2006.01) |
| ***B65B 3/04*** | (2006.01) |
| ***B65D 5/40*** | (2006.01) |
| ***B01F 9/00*** | (2006.01) |
| ***B01F 15/00*** | (2006.01) |

(52) U.S. Cl.

CPC ..... *B65D 77/062* (2013.01); *B01F 9/0001* (2013.01); *B01F 15/0074* (2013.01); *B01F 15/00753* (2013.01); *B65B 3/04* (2013.01); *B65D 5/40* (2013.01); *B65D 77/065* (2013.01)

(58) Field of Classification Search

CPC ..... B65D 77/00; B65D 77/04; B65D 77/06; B65D 77/062; B65D 77/065; B65D 5/40; B01F 9/00; B01F 9/0001; B01F 15/00662; B01F 15/00733; B01F 15/0074; B01F 15/00753; B65B 3/04; B65B 3/045

USPC ..... 220/1.5, 1.6; 222/105, 538, 530; 229/117.34, 154, 117.27, 117.33, 229/117.55; 493/100

See application file for complete search history.

(56) References Cited

U.S. PATENT DOCUMENTS

| | | | | |
|---|---|---|---|---|
| 3,363,822 | A * | 1/1968 | Maulini et al. | 229/117.32 |
| 3,416,717 | A * | 12/1968 | Beck, Jr. et al. | 229/117.32 |
| 3,578,234 | A * | 5/1971 | Marchisen | 229/117.34 |
| 5,427,267 | A * | 6/1995 | Willman | 229/117.34 |
| 2003/0183650 | A1 * | 10/2003 | Muise et al. | 222/105 |
| 2006/0256648 | A1 | 11/2006 | Huckby et al. | |

(Continued)

FOREIGN PATENT DOCUMENTS

| | | |
|---|---|---|
| DE | 3801794 A1 | 7/1989 |
| DE | 4108254 C2 | 9/1992 |

(Continued)

OTHER PUBLICATIONS

English Bibliography for EP 561698A1, published Sep. 22, 1993, printed from Thomson Innovation on Oct. 21, 2014, 4 pp.

(Continued)

*Primary Examiner* — Steven A. Reynolds
*Assistant Examiner* — Javier A Pagan
(74) *Attorney, Agent, or Firm* — Fay Sharpe LLP

(57) ABSTRACT

A receptacle includes a cardboard box in which is arranged a plastics container. A first securement element associated with the plastics container is positioned in a gap defined by the cardboard of the box thereby to restrict movement of the container within the box.

18 Claims, 12 Drawing Sheets

(56) References Cited

U.S. PATENT DOCUMENTS

| | | | | |
|---|---|---|---|---|
| 2012/0138818 | A1 | 6/2012 | Pugh et al. | |
| 2012/0248147 | A1 * | 10/2012 | Krom et al. | 222/135 |

FOREIGN PATENT DOCUMENTS

| | | | |
|---|---|---|---|
| EP | 0561698 | A1 | 9/1993 |
| JP | 8-38871 | | 2/1996 |
| WO | 2008078075 | A2 | 7/2008 |
| WO | 2008078079 | A2 | 7/2008 |
| WO | 2014122425 | A1 | 8/2014 |

OTHER PUBLICATIONS

English Bibliography for DE 4108254C2, published Jun. 8, 1995, printed from Thomson Innovation on Oct. 21, 2014, 4 pp.

English Bibliography for DE 3801794A1, published Jul. 27, 1989, printed from Thomson Innovation on Oct. 21, 2014, 4 pp.

English Bibliograph for JP 08-038871, published Feb. 13, 1996, printed from Thomson Innovation on Oct. 21, 2014, 1 page.

* cited by examiner

FORMULATIONS

PRIORITY CLAIM

This application claims priority to U.S. Provisional Patent Application Ser. No. 61/762,483, filed Feb. 8, 2013. The disclosure of Application Ser. No. 61/762,483 is incorporated by reference herein in its entirety.

BACKGROUND

This invention relates to formulations and particularly, although not exclusively, relates to liquid formulations, methods of producing mixed liquid formulations and apparatus therefor.

WO2008/078079 describes a method of selecting a non-volatile liquid colour formulation for manufacturing a plastic part. The publication also discloses a method of manufacturing the colour formulation using a colour dispense system which includes more than ten base colour formulations which are dispensed in predetermined amounts into a receptacle, in order to define, when mixed, a desired colour.

Various different types of receptacles are in commercial use for delivering liquid formulations. For example, WO2008/078075 describes use of a circular cross-section pail having a wide diameter opening closed by a lid.

Components of formulations may readily be introduced into the pail and mixed using a bladed stirrer because the opening to the pail is so wide. However, pails tend to use a substantial amount of material in their manufacture due to the need for them to be self-supporting and, consequently, tend to be heavy and they are not always readily recycled. Furthermore, in view of their circular cross-section, an array of pails takes up significantly more volume than the volume of their contents and, accordingly, transport costs may be increased compared to a situation wherein suitable receptacles could be packed together more efficiently.

Receptacles which comprise a so-called "bag-in-a-box" are well known. These comprise a collapsible plastics inner receptacle having a narrow diameter inlet/outlet opening for passage of liquid into and out of the inner receptacle and an outer cuboid cardboard box in which the inner receptacle is arranged with its inlet/outlet opening projecting through the box to the outside. Advantageously, bag-in-a-box receptacles can be packed together very efficiently and are readily recycled after use. However, there are disadvantages associated with such receptacles. Firstly, due to the narrow diameter of the inlet/outlet opening, it is not possible using the colour dispense system of WO02008/078079 to dispense base colour formulations from their individual dispense heads directly into a receptacle. So, if it is desired to use a bag-in-a-box receptacle, the colour dispense system must dispense the base colour formulations into an intermediate receptacle (e.g. it may be a pail). After mixing of the base colour formulations in the intermediate receptacle, mixed formulation may be decanted or piped into the bag-in-a-box receptacle which can then be shipped to a customer for use.

A second disadvantage associated with the bag-in-a-box receptacles has, after tests, been appreciated by the Applicant, namely that complete mixing of the contents of such receptacles can be difficult if the integrity of the receptacle is to be maintained. For example, it has been found that shaking, rotating or application of a vibratory force to such a receptacle causes the bag part of the receptacle to move within the box part of the receptacle which, over a short period of time, damages the box part by penetrating the cardboard or compressing it and making it floppy or not self-supporting. As a result, the box part would need replacing before shipping to a customer which is impractical. In addition, corners of the bag part of such a receptacle tend to comprise thinner material, as a result of the blow moulding process used in their manufacture. The corners tend to be subjected to more impact as the bag part moves within the box part which risks penetration of the bag part and/or leakage. Thus, it is difficult to use a bag-in-a-box receptacle when the content of the receptacle needs to be vigorously mixed after introduction into the receptacle.

It is an object of the present invention to address the above described problems.

BRIEF DESCRIPTION

According to a first aspect of the invention, there is provided a receptacle comprising a cardboard box in which is arranged a plastics container, wherein a first securement element associated with the plastics container is positioned in a gap defined by the cardboard of the box thereby to restrict movement of the container within the box.

Said first securement element is preferably an integral part of said plastics container. It is preferably positioned outside a part of said container which contains fluid in use. It is preferably unitary with said part of said container which contains fluid in use. It is preferably not arranged to be detached from said part of said container which contains fluid in use. It is preferably a component of a unitary moulding which includes at least a part of said part of said container which contains fluid in use.

Said first securement element preferably defines a male element which is positioned in said gap. Said first securement element is preferably elongate. It preferably extends at least 50%, suitably at least 85%, more preferably at least 95% along the length of a first side of container. In an especially preferred embodiment, it extends across substantially the entire extent of said first side of said container. The width of the first securement element measured in a direction transverse (e.g. perpendicular) to the elongate extent thereof is suitably less than 50% (e.g. less than 25%) of the length (measured in the direction of the elongate extent) of the first securement element. The ratio of the length of said first securement element to the width thereof is suitably at least 5, preferably at least 10. Said ratio may be less than 30, less than 20 or less than 15. The ratio of the thickness of the first securement element to the width is suitably in the range 5 to 20.

Said first securement element preferably comprises an elongate tab. Said element is preferably substantially rectangular.

Said first securement element may have a maximum thickness in the range 1 to 4 mm,a maximum length in the range 15 to 50 cm; and a maximum width in the range 20 to 50 mm.

Preferably, said gap is defined, at least in part, by a first flap of the box, suitably wherein said first flap is pivotable between open and closed positions during opening and/or closing and/or assembly of the box. Said first flap preferably extends substantially along the extent of a (or preferably the) first side of said plastics container. Said first flap preferably has a face having an area which is greater than the area of a face of said first securement member with which it is in contact. Said first flap and said first securement element preferably make face to face contact, suitably with said first flap overlying (and preferably substantially fully covering) said first securement element. Said first flap preferably has a maximum width which is greater than the maximum width of said first securement element. Preferably the ratio of the maximum width of said first flap to the maximum width of said first securement element is in the range 1.5 to 5.

Preferably, said gap is defined, at least in part, between said first flap and a second flap of the box, suitably wherein said second flap is pivotable between open and closed positions during opening and/or closing and/or assembly of the box. Said second flap preferably extends substantially along the extent of a second side of the plastics container which second side suitably extends in a direction which is substantially perpendicular to the first side. Said second flap preferably is positioned underneath the first securement element and a lower face of the first securement element suitably makes face to face contact with an upper face of the second flap. Thus, the first securement element suitably is positioned between and/or makes face to face contact with said first flap and said second flap.

Preferably, said gap is defined, at least in part, between said first flap, said second flap and a third flap of the box, wherein said third flap is pivotable between open and closed positions during opening and/or closing and/or assembly of the box. Said third flap suitably extends substantially parallel to said second flap. Said third flap preferably is positioned underneath the first securement element and a lower face of the first securement element suitably makes face to face contact with an upper face of the third flap. Thus, the first securement element is suitably positioned between and/or makes face to face contact with said first flap, second flap and said third flap, wherein said first flap is above the first securement element and said second and third flaps are below the first securement element.

The box suitably including a fourth flap which extends parallel to the first flap and/or is pivotable about an axis defined on an opposite side of the box to that of the first flap. The fourth flap suitably does not contact the first securement element. It suitably overlies the second and third flaps.

Tape is suitably applied to the cardboard box to facilitate retention of the first securement element in said gap. When the box includes first, second, third and fourth flaps, tape is preferably applied across a contiguous region defined between the first and fourth flaps.

Preferably a second securement element is associated with said plastics container and is positioned in a second gap defined by the cardboard of the box thereby to provide a further means (in addition to said first securement element) of restricting movement of the container within the box.

Said second securement element is suitably spaced from said first securement element. Said first and second securement elements suitably extend substantially parallel to one another. Said first securement element is suitably associated with a top wall of the box and said second securement element is suitably associated with a bottom wall of the box. Said first and second securement elements are suitably diagonally opposite one another.

Said second securement element preferably functions and/or is arranged substantially in the manner of said first securement element.

Said second securement element is preferably an integral part of said plastics container. It is preferably positioned outside a part of said container which contains fluid in the use. It is preferably unitary with said part of said container which contains fluid in use. It is preferably not arranged to be detached from said part of said container which contains fluid in use. It is preferably a component of a unitary moulding which includes at least a part of said part of said container which contains fluid in use.

Said second securement element preferably defines a male element which is positioned in said gap. Said second securement element is preferably elongate. It preferably extends at least 50%, suitably at least 85%, more preferably at least 95% along the length of a third side of container which is suitably a lower side of said container and is preferably diagonally opposite said first side. In an especially preferred embodiment, said second securement element extends along substantially the entire extent of said third side of said container. The width of the second securement element measured in a direction transverse (e.g. perpendicular) to the elongate extent thereof is suitably less than 50% (e.g. less than 25%) of the length (measured in the direction of the elongate extent) of the second securement element. The ratio of the length of said second securement element to the width thereof is suitably at least 5, preferably at least 10. Said ratio may be less than 30, less than 20, or less than 15. The ratio of the thickness of the second securement element to the width is suitably 5 to 20.

Said second securement element preferably comprises an elongate tab. Said element is preferably substantially rectangular.

Said second securement element may have a maximum thickness in the range 1 to 4 mm, a maximum length in the range 15 to 50 cm; and a maximum width in the range 20 to 50 mm.

Preferably, said second gap is defined, at least in part, by a fifth flap of the box, suitably wherein said fifth flap is pivotable between open and closed positions during opening and/or closing and/or assembly of the box. Said fifth flap preferably extends substantially along the extent of a (or preferably the) third side of the said container. Said fifth flap preferably has a face having an area which is greater than the area of a face of said second securement element with which is in contact. Said fifth flap and said second securement element preferably make face to face contact, suitably with said fifth flap underlying (and preferably substantially fully covering) said second securement element. Said fifth flap preferably has a maximum width which is greater than the maximum width of said second securement element. Preferably the ratio of the maximum width of said fifth flap to the maximum width of said second securement element is in the range 1.5 to 5.

Preferably, said second gap is defined, at least in part, between said fifth flap and a sixth flap of the box, suitably wherein said sixth flap is pivotable between open and closed positions during opening and/or closing and/or assembly of the box. Said sixth flap preferably extends substantially along the extent of a fourth side of the container which fourth side suitably extends in a direction which is substantially perpendicular to the third side. Said sixth flap preferably is positioned above the second securement element and an upper face of the second securement element suitably makes face to face contact with a lower face of the sixth flap. Thus, the second securement element suitably is positioned between and/or makes face to face contact with said fifth flap and said sixth flap. Preferably, said second gap is defined, at least in part, between said fifth flap, said sixth flap, and a seventh flap of the box, wherein said seventh flap is pivotable between open and closed positions during opening and/or closing and/or assembly of the box. Said seventh flap suitably extends substantially parallel to said sixth flap. Said seventh flap preferably is positioned above the second securement element and an upper face of the second securement element suitably makes face to face contact with a lower face of the seventh flap. Thus, the second securement element is suitably positioned between and/or makes face to face contact with said fifth flap, said sixth flap and said seventh flap, wherein said fifth flap is below the second securement element and said sixth and seventh flaps are above the second securement element.

The box suitably includes an eighth flap which extends parallel to the fifth flap and/or is pivotable about an axis defined on an opposite side of the box to that of the fifth flap. The eighth flap suitably does not contact the second securement element. It suitably underlies the sixth and seventh flaps.

Tape is suitably applied to the cardboard box to facilitate retention of the second securement element in said second gap. When the box includes fifth, sixth, seventh and eighth flaps, tape is preferably applied across a contiguous region defined between the fifth and eighth flaps.

In a preferred embodiment, said plastics container includes a said first securement element and a said second securement element as described, wherein said first and second elements are elongate, extend parallel to and are diagonally opposite one another, wherein said first securement element is positioned between a first flap on one side and second and third flaps on an opposite side; and wherein said second securement element is positioned between a fifth flap on one side and sixth and seventh flaps on an opposite side.

Said cardboard box is preferably substantially cuboid.

Said plastics container is preferably substantially cuboid when full of liquid. It preferably substantially fills the cardboard box. For example, the plastics container may occupy at least 90% or at least 95% of the internal volume of the cardboard box. Each side of the plastics container suitably abuts, at least in part, an internal wall of the cardboard box.

Said plastics container may be made from a polyolefin, for example a polyethylene such as LDPE. It may be made by vacuum moulding which may be used to define two parts thereof which are welded together to define the container.

Said plastics container is preferably not self-supporting. It is preferably collapsible—that is, suitably as liquid is removed therefrom in use, the internal volume of the plastics container reduces, for example down to less than 10% of its volume when full of liquid.

Said plastics container preferably includes a first opening for passage of liquid from the container. The first opening may be provided in a lower wall of the container. The first opening suitably has a diameter of 10 to 45 mm, preferably 20 to 45 mm, more preferably 20 to 40 mm. It suitably has a circular cross-section. Said opening is preferably positioned closer to one side of the plastics container than it is to a side opposite the one side. Said opening is preferably provided with a closure which is suitably releasably securable for closing the opening.

Said plastics container preferably includes a second opening for passage of liquid into the container for example from a dispense device as hereinafter described. The second opening may be provided in a wall of the container which is opposite to that of said lower wall. The second opening suitably has a diameter which is greater than that of the first opening. For example, the ratio of the diameter of the second opening to that of the first opening may be in the range 1.5 to 6, preferably 2 to 4. The second opening suitably has a diameter of 50 to 150 mm, preferably 50 to 120 mm, more preferably 50 to 110 mm. It suitably has a circular cross-section. Said second opening preferably traverses a centre of one side (suitably a top side) of the container and, more preferably, the centre of the second opening is less than 10 mm from the centre of said one side (e.g. said top side). The centre of the opening and the centre of the one side are preferably substantially coincident. Said second opening is preferably provided with a closure which is suitably releasably securable for closing the opening.

In one embodiment, said plastics container may include first and second openings as described. In another embodiment, said plastics container may only include a first opening in which case, suitably, said first opening has a diameter in the range 40 to 60 mm.

Said plastics container suitably contains a liquid formulation which may include a colourant or other additive, wherein said liquid formulation is for addition to a plastics material in the manufacture of a plastics part.

Said liquid formulation is preferably shear thinning.

Said liquid formulation suitably comprises a vehicle and an active component which it is desired to introduce into a plastics material. The active component could be solubilised in said vehicle. However, preferably the active component is provided as a dispersion in said vehicle. Thus, the active component is preferably generally insoluble in said vehicle.

Said liquid formulation may include 15-99 wt %, suitably 20-95 wt %, preferably 30-85 wt %, more preferably 30-70 wt %, especially 40-60 wt % of said vehicle. Said liquid formulation may include 1-85 wt %, suitably 5-80 wt %, preferably 15-70 wt %, more preferably 30-70 wt %, especially 40-60 wt % of said active component. The total wt % of all dispersed solids in said vehicle may be 1-85 wt %, suitably 5-80 wt %, preferably 15-70 wt %, more preferably 30-70 wt %, especially 40-70 wt % of solids.

The active component may be arranged to adjust a property of a plastics material into which it may be delivered. Said active material may be any material that it is desired to introduce into a plastics material and includes colorants, UV filters, oxygen absorbers, antimicrobial agents, acetaldehyde scavengers, reheat additives, antioxidants, light stabilizers, optical brighteners, processing stabilizers and flame retardants. Colorants may comprise pigments or dyes.

Said additive is preferably a colorant. Thus, said liquid formulation preferably comprises a colorant. A colorant can be a pigment, a dye, a combination of pigments, a combination of dyes, or a combination of pigments and dye.

Said vehicle is preferably a liquid vehicle. Illustrative liquid vehicles include but are not limited to: mineral oils, $C_9$-$C_{22}$ fatty acid esters, ethoxylated $C_9$-$C_{22}$ fatty acid esters, ethoxylated alcohols and plasticizers. Plasticizers may for example be sebacates and azelates, such as dibutyl sebacate, esters such as benzyl benzoate, adipates such as dioctyladipate, citrates such as triethyl citrate, epoxies, phosphate esters such as 2-ethylhexyl diphenyl phosphate, phthalates such as dioctylphthalate, and secondary plasticisers such as chlorinated paraffins Said liquid formulation may have a viscosity, measured using a Brookfield Viscometer at 2 rpm and 23° C., of greater than 100 cP. Said liquid formulation may have a viscosity, measured using a Brookfield Viscometer at 20 rpm and 23° C., of less than 50,000 cP or less than 30,000 cP. The viscosity measured as aforesaid is preferably in the range 200 to 30,000 cP.

As described, said liquid formulation is preferably shear thinning. The additive may have a shear thinning index (STI) measured as described at page 9, line 19 to line 30 of WO2010/116161 of at least 1.5, preferably at least 2, more preferably at least 2.5. The STI may be less than 25, preferably less than 15, more preferably less than 10.

Said formulation suitably includes at least two, preferably at least three, more preferably at least four different colourants selected from pigments and dyes.

In a preferred embodiment, said receptacle is ready for shipment to a customer. In this case, it preferably includes a homogenous liquid formulation. Suitably, therefore, pigments and/or dyes are completely mixed with a vehicle of the formulation. In another embodiment, said receptacle may include a formulation prior to mixing in the method described in the first aspect hereinafter. In this case, said receptacle may include a liquid formulation which is not homogenously mixed and/or needs to be mixed before it can be shipped to a customer and/or used in a process wherein it is introduced into a plastics material.

According to a second aspect of the invention, there is provided a receptacle comprising a cardboard box in which is arranged a plastics container, wherein said plastics container includes a first opening for passage of liquid from the container and a second opening for passage of liquid into the container.

Said first and second openings may have any feature of the first and second openings of the first aspect. In a preferred embodiment, said first opening is provided in a lower wall of the plastics container and has a diameter in the range 20 to 45 mm; said second opening is provided in a wall of the container which is opposite to that of said lower wall and has a diameter in the range 50 to 150 mm and wherein the ratio of the diameter of the second opening to that of the first opening is in the range 1.5 to 6, preferably 2 to 4.

According to a third aspect of the invention, there is provided a method of producing a liquid formulation in a receptacle, the method comprising:

(i) selecting a receptacle comprising a cardboard box in which is arranged a plastics container (ii) operating a dispense device to dispense a first component formulation into the plastics container of the receptacle;

(iii) operating the dispense device to dispense a second component formulation which is different to said first component formulation into the plastics container of the receptacle;

(iv) optionally, repeating step (iii) to dispense further component formulations into the plastics container, wherein said further component formulations are different from one another.

Said component formulations may include any type of active component arranged to adjust a property of a plastics material into which the liquid formulation may subsequently be delivered. A list of active materials is described in the first aspect. Such active materials may be dispensed or dissolved in a vehicle as described according to the first aspect. Preferably, however, said first and second component formulations comprise colourants, for example, pigments or dyes. Preferably, said first and second component formulations comprise liquid formulations comprising a vehicle and colourant (e.g. pigment or dye). The further component formulations described in step (iv) may also comprise liquid formulations comprising a vehicle and pigments or dyes.

The liquid formulation of the third aspect may have any feature of the liquid formulation of the first aspect, for example in terms of liquid vehicle, colourant types, viscosity, shear thinning nature and STI.

The dispense device preferably includes said first component formulation, said second component formulation and at least eight other respective component formulations. Said device preferably includes at least ten component formulations which are different from one another. In the method, the amount of each component formulation to be dispensed is suitably communicated to the dispense device from a computer. Dispense of the first component formulation suitably comprises relative movement between a dispense head for the first component formulation and an inlet of the receptacle so the dispense head is above an inlet of the receptacle, followed by dispense of the formulation into the plastics container via said inlet. Dispense of the second component formulation may involve relative movement between a dispense head for the second component formulation and an inlet of the receptacle so the dispense head is above the inlet of the receptacle, following by dispense of the formulation into the plastics container via said inlet. Dispensing heads associated with other component formulations may in turn, be positioned above the inlet and formulations dispensed as described.

Dispense into the plastics container is suitably via the second opening in said container described according to said first aspect.

After dispense of first, second and any other component formulations, said inlet, for example, said second opening, is closed by a closure. The method may also include covering the inlet and/or closure by movement of respective flaps of the box to closed positions; and suitably the flaps are then secured in position by tape.

After dispense of first, second and any other component formulations, the liquid formulation in the container comprises an unmixed mass. The method of the third aspect preferably comprises mixing the liquid in the receptacle, suitably after the second opening has been closed, suitably using a screw-threaded cap.

Mixing of said unmixed mass preferably involves a non-invasive mixing means. The mass may be mixed for 1 minute to 4 minutes. Preferably, said mixing means comprises rotating the receptacle about a first axis. It may be rotated at 50 to 250 rpm, suitably 90 to 190 rpm. It may involve rotating the receptacle about a second axis which is preferably perpendicular to the first axis. It may be rotated at 50 to 250 rpm, suitably 90 to 190 rpm about the second axis. Rotation about said first and second axes is preferably concurrent. The ratio of the rpm about the first axis to the rpm about the second axis may be in the range 0.9 to 1.1. Said mixing means suitable comprises gyroscopic mixing.

Said receptacle of said third aspect may include any feature of the receptacle of the first or second aspects.

Although the receptacle of the first and second aspects is modified to minimise damage to it during mixing by said mixing means, the method suitably comprises supporting the receptacle using a receptacle support as described hereinafter in the fourth aspect. In the method, each outwardly facing face of said receptacle is preferably contacted by a respective one of first, second, third, fourth, fifth and sixth surfaces associated with the receptacle support. The method may comprise clamping the receptacle in position. A single movable clamp surface is suitably provided which is movable to contact one surface of the receptacle and clamp the receptacle in position.

According to a fourth aspect of the invention, there is provided a mixing device for a receptacle of the first and second aspects and/or for use in the method of the third aspect, said mixing device comprising a receptacle support which comprises:

(i) a first member (which is suitably a platform) having a first surface arranged to make face to face contact with a first surface of the receptacle;

(ii) a second member which has a second surface which extends in a direction perpendicular to the first surface and is arranged to make face to face contact with a second surface of the receptacle, wherein the second surface of the receptacle extends in a direction which is perpendicular to the first surface of the receptacle;

(iii) a third member which has a third surface which extends in a direction perpendicular to the first surface and is arranged to make face to face contact with a third surface of the receptacle, wherein the third surface of the receptacle extends in a direction which is perpendicular to the first surface of the receptacle and suitably faces in an opposite direction to that of said second surface;

(iv) a fourth member which has a fourth surface which extends in a direction perpendicular to the first surface and is arranged to make face to face contact with a fourth surface of the receptacle, wherein the fourth surface of the receptacle extends in a direction which is perpendicular to the first surface of the receptacle;

(v) a fifth member which has a fifth surface which extends in a direction perpendicular to the first surface and is arranged to make face to face contact with a fifth surface of the receptacle, wherein the fifth surface of the receptacle extends in a direction which is perpendicular to the first surface of the receptacle;

(vi) a sixth member which has a sixth surface which extends in a direction perpendicular to the second, third, fourth and fifth surfaces and is arranged to make face to face contact with a sixth surface of the receptacle, wherein said sixth surface faces in an opposite direction to the first surface.

Said receptacle support preferably includes a clamp means for clamping the receptacle in position between said first, second, third, fourth, fifth and sixth surfaces. Said clamp means may comprise said sixth surface being movable between a first position in which it is arranged to apply a clamping force to clamp the receptacle in position and a second position in which the clamping force is released.

Said first, second, third, fourth, fifth and sixth members of said receptacle support are suitably arranged to define an enclosure in which the receptacle may be received, suitably so the receptacle is held firmly but with not too much force as to significantly squash the receptacle and/or the cardboard thereof. The enclosure is suitably arranged such that six faces of the receptacle are contacted with (and suitably make face to face contact with) a respective one of said first to sixth members so the receptacle is supported and/or contacted on all six of its sides.

Said first surface of said first member is preferably arranged to overlie at least 50% (more preferably at least 95%) of the area of the first surface of the receptacle.

Said second surface of said second member is preferably arranged to overlie at least 50% (more preferably at least 95%) of the area of said second surface of the receptacle.

Said third surface of said third member is preferably arranged to overlie at least 50% (more preferably at least 95%) of the area of said third surface of the receptacle.

Said fourth surface of said fourth member is preferably arranged to overlie at least 50% (more preferably at least 95%) of the area of said fourth surface of the receptacle.

Said fifth surface of said fifth member is preferably arranged to overlie at least 10% or at least 20% of the area of the fifth surface of the receptacle.

Said sixth surface of said sixth member is preferably arranged to overlie at least 50% (more preferably at least 95%) of the area of said sixth surface of the receptacle.

Said receptacle support may comprise a tray arranged to engage the receptacle, wherein the tray is releasably securable within a housing, wherein the housing includes said second, third and fourth members and a base on which said tray is slideably supported. The tray suitably includes a square cross-section. It suitably includes a base arranged to support the receptacle and fourth upstanding side walls which define a square cross-section socket for receiving the receptacle. The tray suitably includes a handle for facilitating its input and removal from the housing. A roller is preferably associated with the housing for facilitating removal of the tray from the housing. Stop means is preferably associated with the housing for restricting removal of the tray from the housing. Said receptacle support is preferably movable, for example arranged to be rotated for example about two orthogonal axes suitably to effect gyroscopic mixing in use of the contents of a receptacle engaged with the receptacle support.

Said mixing device of the fourth aspect suitably include a mixing means, for example a gyroscopic mixing means.

Said mixing device may include a receptacle associated with the receptacle support as described.

According to a fifth aspect, there is provided apparatus for producing a homogenously mixed liquid formulation, the apparatus comprising:

- a multiplicity of receptacles according to the first and/or second aspects;
- a dispense device for dispensing component formulations into the receptacles, said dispense device including a first component formulation, a second component formulation and at least eight other component formulations, wherein said dispense device and component formulations have any feature of the aforesaid described according to any preceding aspect.
- a mixing device for mixing component formulations in said receptacles, said mixing device having any feature of the mixing device of the fourth aspect.

According to a sixth aspect of the invention, there is provided a method of colouring a polymeric material, the method comprising:

(i) selecting a receptacle according to the first or second aspects or produced according to the third aspect, wherein said receptacle contains a homogenous liquid formulation described according to the first aspect and which suitably includes a vehicle and one or more colourants;

(ii) operatively connecting the outlet of the receptacle to a dosing pump;

(iii) delivering liquid formulation from said receptacle into a plastics material so that it mixes with the plastics material. For example, said liquid formulation may be delivered to a premixer stage of plastics forming equipment such as an injection moulder or extruder.

Any aspect of any invention described herein may be combined with any feature of any other aspect of any other inventions described herein *mutatis mutandis*.

Specific embodiments of the invention will now be described, by way of example, with reference to the accompanying drawings, in which:

DETAILED DESCRIPTION

Figure 1A:
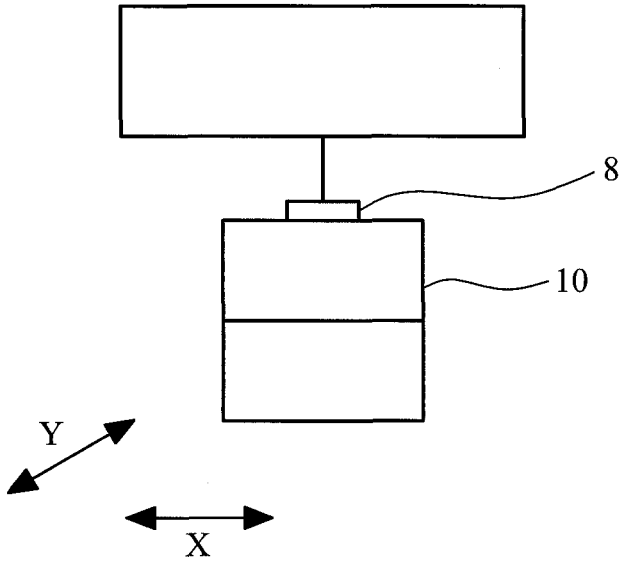
FIGS. 1*a* and 1*b* are a front elevation and plan view respectively of a colour formulation dispensing device arranged for delivery of base colour formulations into a receptacle.
Figure 1B:
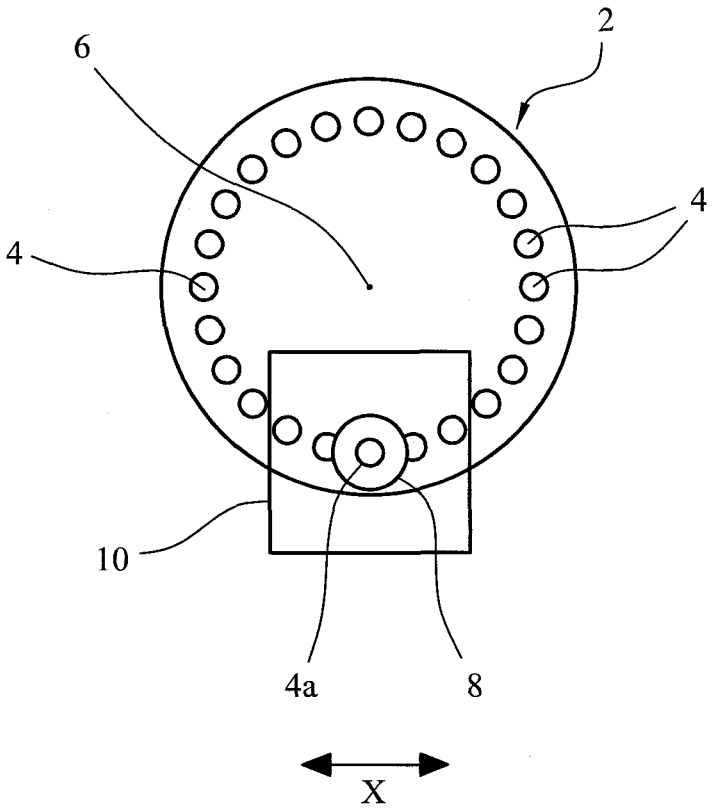

Referring to FIG. 1, a dispensing head 2 of the dispensing device includes individual dispensing members 4 arranged around a central axis 6. A receptacle 10 is moveable so that its inlet 8 may be positioned directly underneath selected members 4 from which respective liquid base colour formulations (which are suitably liquid dispersions comprising pigments and/or dyes) can be dispensed directly into the receptacle. In FIG. 1, dispensing member 4*a* is shown above inlet 8; it may deliver one base colour formulation into the receptacle 10; the receptacle may then be positioned below selected other dispensing members and quantities of other base colour formulations can be delivered into the receptacle. The amount of each base colour formulation to be dispensed, the indexing of the receptacle 10 and the actual dispense of the base colour formulations are suitably computer controlled. After dispense of the base colour formulations, the receptacle 10 will include an unmixed colour formulation. This must be completely mixed before it is shipped to a customer. The base formulations may be relatively viscous (typical viscosities in the range 100 and 30,000 cP when measured as described herein) which means that relatively vigorous mixing is required to define a homogenous mixture.

As described further below, the receptacle 10 is constructed to facilitate dispense from the dispensing head, mixing of the formulation dispensed and maintenance of the integrity of the receptacle (e.g. a box part 40 described further below). In addition, apparatus is described for supporting the receptacle 10 during mixing.

Figure 2B:
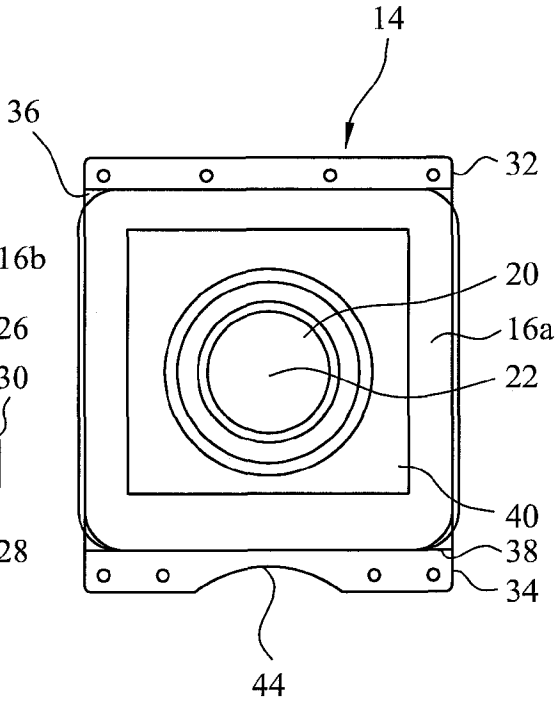
FIG. 2*b* is a top view of the liner.
Figure 2C:
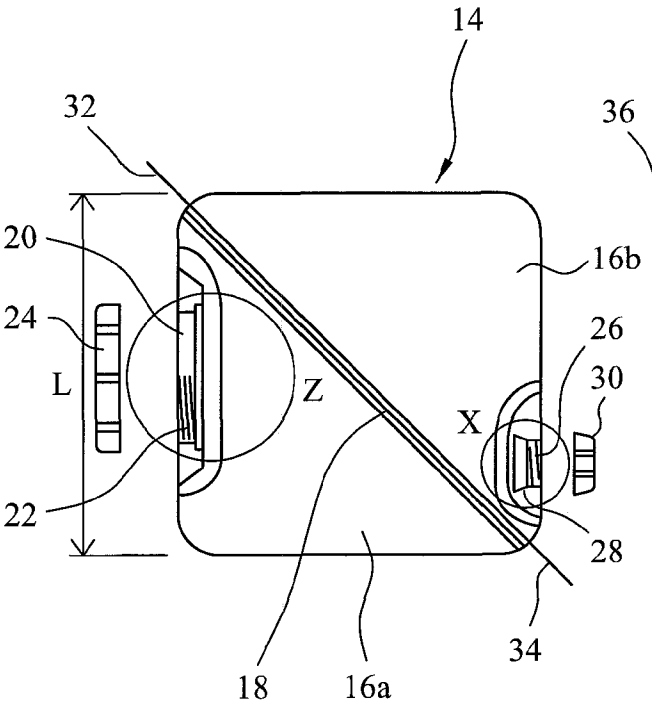
FIG. 2*c* is a side view of the liner.

Referring to FIG. 2*c*, liner 14 comprises two flexible and collapsible halves 16*a*, 16*b*. These are formed from two simultaneously extruded sheets of LDPE which are blown, formed and sealed along a diagonally extending region 18 of the liner, in a single process. They could alternatively be made from pre-cast films. As shown in FIG. 2*c*, half 16*a* includes a central inlet orifice 20 which includes a screw-threaded region 22 which is arranged to releasably engage a screw-threaded cap 24. Orifice 20 has a diameter of about 100 mm which is sufficiently wide that dispensing members 4 (FIG. 1) can easily dispense colour formulations into the liner via the orifice.

Figure 2A:
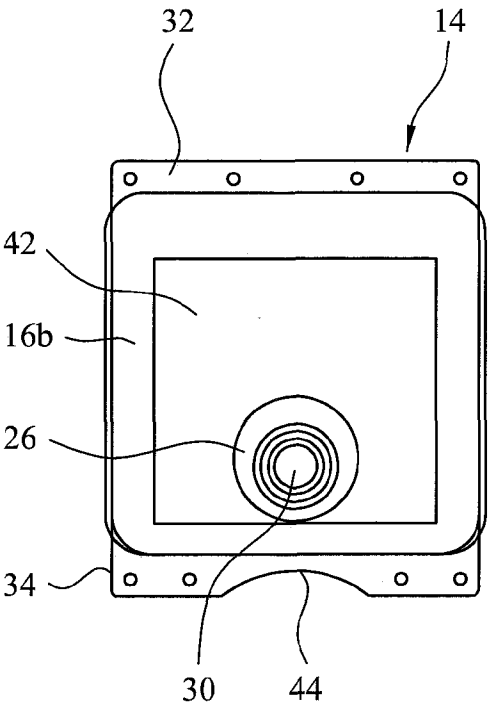
FIG. 2*a* is a bottom view of a liner (i.e. "bag" part) of the receptacle.
Figure 2E:
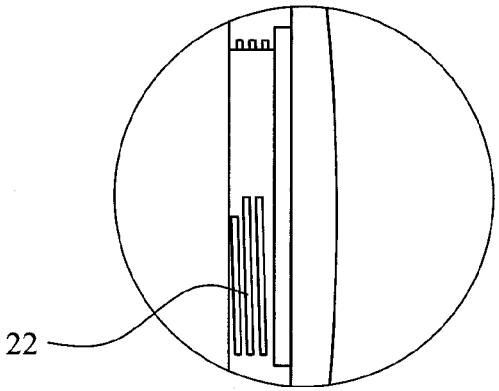
FIG. 2*e* is a detailed view of part Z of FIG. 2*c;*
Figure 2D:
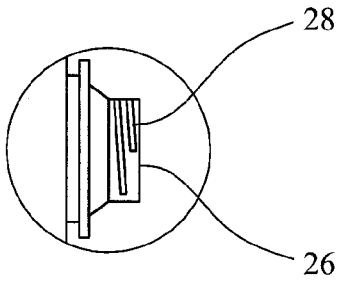
FIG. 2*d* is a detailed view of part X of FIG. 2*c;*
Figure 2F:
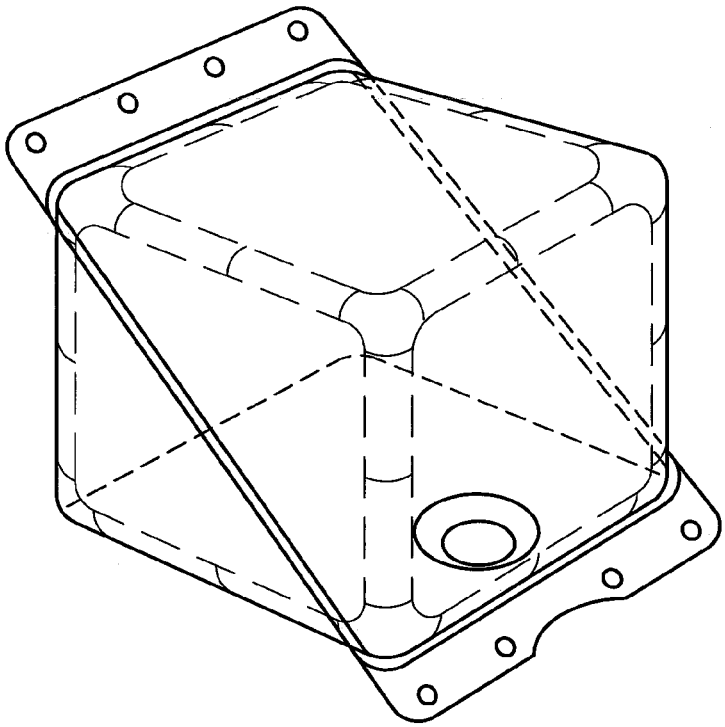
FIG. 2*f* is a perspective view, partly in cross-section, of the liner (with a filling orifice omitted in the interests of clarity)

As shown in FIG. 2*a*, half 16*b* includes an outlet orifice 26 which includes a screw-threaded region 28 which is arranged to releasably engage a screw-threaded cap 30. Orifice 26 has a diameter of about 31 mm which is too narrow for it to cooperate with dispensing members 4 (FIG. 1) but is suitable to be used as an outlet for delivery of liquid colour formulations to wherever they may be required. A tube may be connected to the outlet to facilitate delivery of the liquid formulations.

The liner 14 includes a first elongate substantially rectangular tab 32 and a second elongate substantially rectangular tab 34. The first tab 32 is hinged about a weakened portion 36 (FIG. 2*b*) so the tab can be moved to a position in which it makes face to face contact with face 40 of the liner. The second tab 34 is hinged about a weakened portion 38 (FIG. 2*b*) so the tab can be moved to a position in which it makes face to fact contact with face 42 of the liner. The tab 34 includes an arcuate cut out region 44 which is positioned so the tab is accommodated partly around orifice 26 when the tab 34 makes contact with face 42 as aforesaid.

The first and second tabs are arranged to secure the liner within the box part 11 of receptacle 10 as described below.

The liner 14 has a length (L) and height (H) of about 306 mm (for receptacles of 25 liters capacity).

Figure 3:
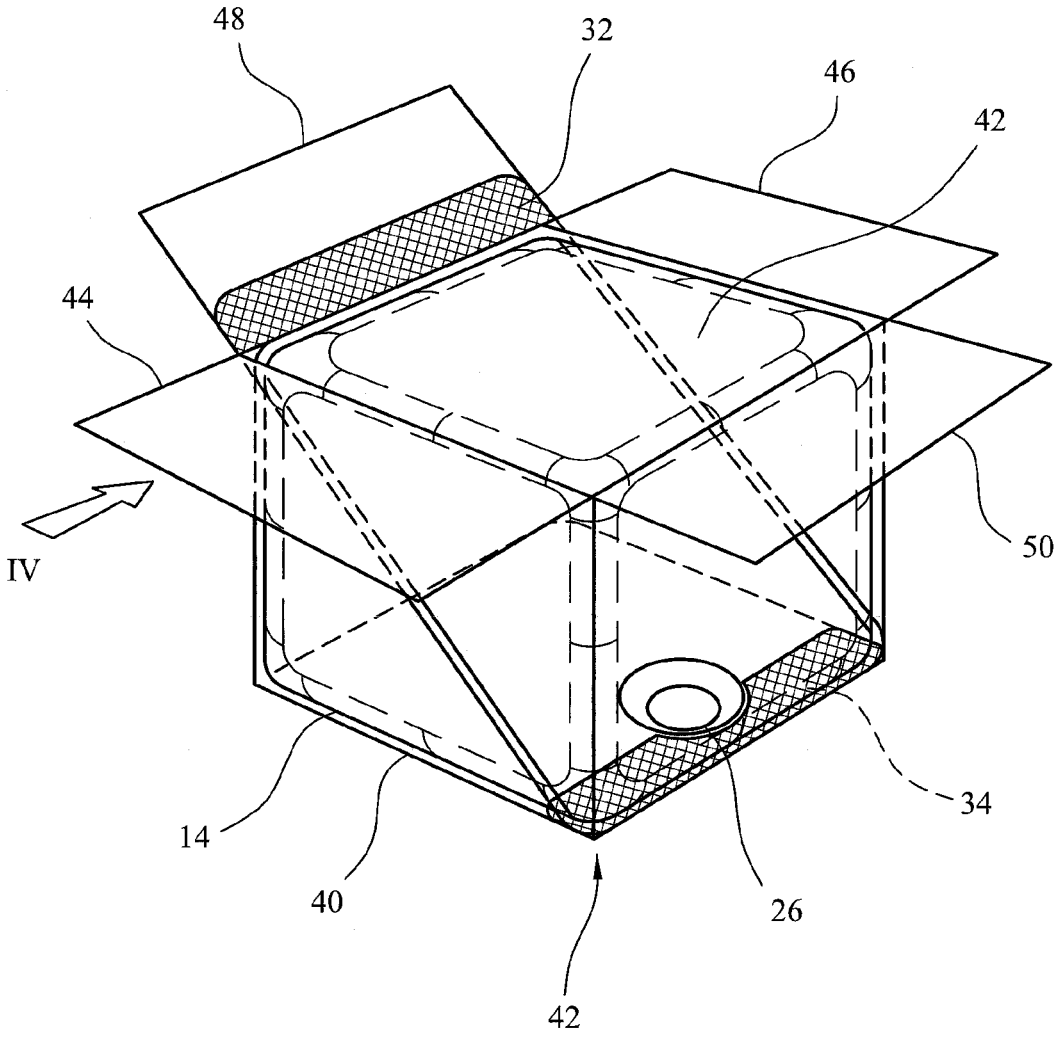
FIG. 3 is a perspective view, partly in cross-section, of a liner being secured within a cuboid cardboard box.

The box part of receptacle 10 is made from a standard cardboard blank for construction of a cardboard box which the liner 14 is arranged to engage. In FIG. 3, the liner 14 is shown positioned within the box 40 with the bottom 42 of the box closed and the tab 34 secured in position between two flaps of the box, so upwardly and downwardly facing faces of the tab 34 make face to face contact with respective flaps of the box. Detail on this has been omitted from FIG. 3 in the interests of clarity but it is analogous to securement of tab 32 of the box between flaps 44, 46 and 48 as described below.

As apparent from FIG. 3, the liner 42 is positioned in box 40 with its orifice 26 aligned with an orifice in the box. Although orifice 26 of FIG. 2 has been omitted from FIG. 3 in the interests of clarity, it will be appreciated that it is provided in face 42 of the liner.

The box 40 includes hinged flaps 44, 46, 48 and 50 which in FIG. 3 are shown in the open positions. To close the box and secure the tab 32 (and therefore liner 14 in position), firstly flaps 44, 46 are pivoted through about 180° from the FIG. 3 position so they lie substantially flat upon face 42 of the liner. Then flaps 48 and 50 are pivoted through about 180° so they lie flat upon the flaps 44, 46. When flap 48 is pivoted, tab 32 (which makes face to face contact with flap 48) is also pivoted so it lies flat on flaps 44, 46 and is sandwiched between flaps 44, 46 on one side and flap 48 on its upper side. The flaps 44, 46, 48, 50 may then be secured in their closed positions using tape 52 (FIG. 4).

Figure 4:
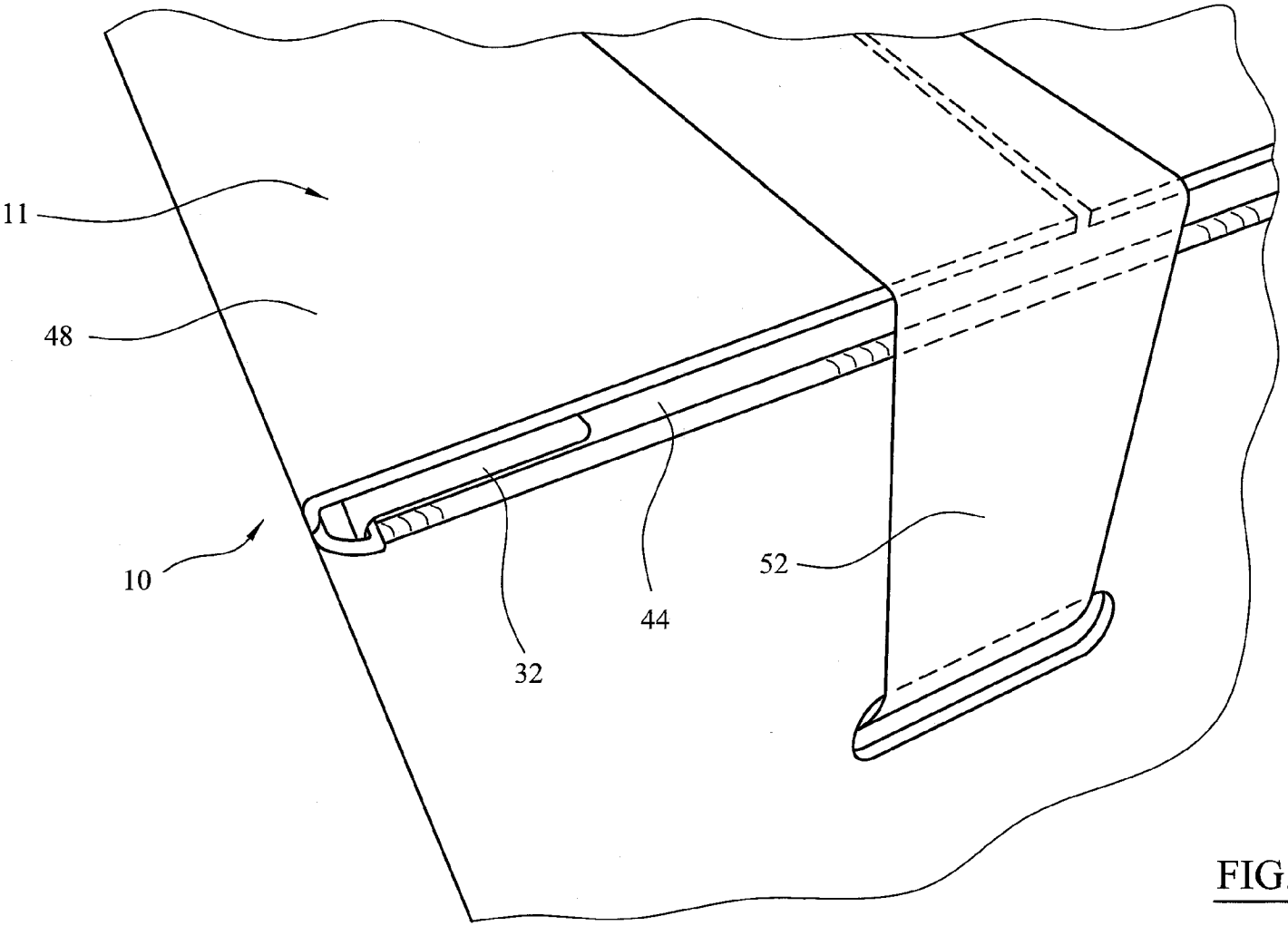
FIG. 4 is a perspective view slightly from above in the direction of arrow IV of FIG. 3 wherein the flaps of the box have been closed and taped in a closed position.

FIG. 4 shows one corner of the closed receptacle 10, wherein tab 32 of the liner 14 is wedged between flaps 44 and 48 and tape 52 secures the flaps of the box 40 in position. The same view will be apparent at each corner of the receptacle. Thus, it should be appreciated that tabs 32, 34 are securely positioned between flaps of the box along diagonally spaced apart top and bottom edges of the box. As a result, the liner is secured in position within the box 40 and is substantially restricted from moving relative thereto.

Agitation of the receptacle 10 to mix its content is achieved using mixing apparatus as shown in FIGS. 5. The apparatus includes a housing 60 which houses a gyroscopic mixer 62 with which is associated a support assembly for supporting the receptacle 10 during mixing. A roller conveyor 64 is positioned adjacent the housing for facilitating introduction and removal of the receptacle from the housing. Components of the apparatus are described in more detail below.

The support assembly includes a first support structure 65 (FIG. 5*c*) which includes a circular base 66 which supports spaced apart upstanding square side walls 68 and rear wall 70 which are arranged define an opening which snugly receives the receptacle 10 such that a top region 72 (FIG. 5*e*) of the receptacle protrudes slightly above the upper edges of walls 68. In front of the walls 68 is a roller 74 which is rotatably supported at opposite ends by structures 76.

The support assembly include a tray 80 (FIG. 5*d*) which defines a square cross-section socket which is arranged to snugly engage the receptacle 10. More particularly, the tray includes a square base 82, upstanding front wall 84, opposing side walls 86 and rear wall 88 which together are arranged to snugly engage a bottom region of receptacle 10. The tray (and receptacle container therein) are arranged to be slid into (and removed from) the first support structure 65 using a handle 90. When so arranged the tray 80 is restricted from sliding out of the structure 65 by the close proximity of structures 76 which thereby act as stop members.

Figure 5A:
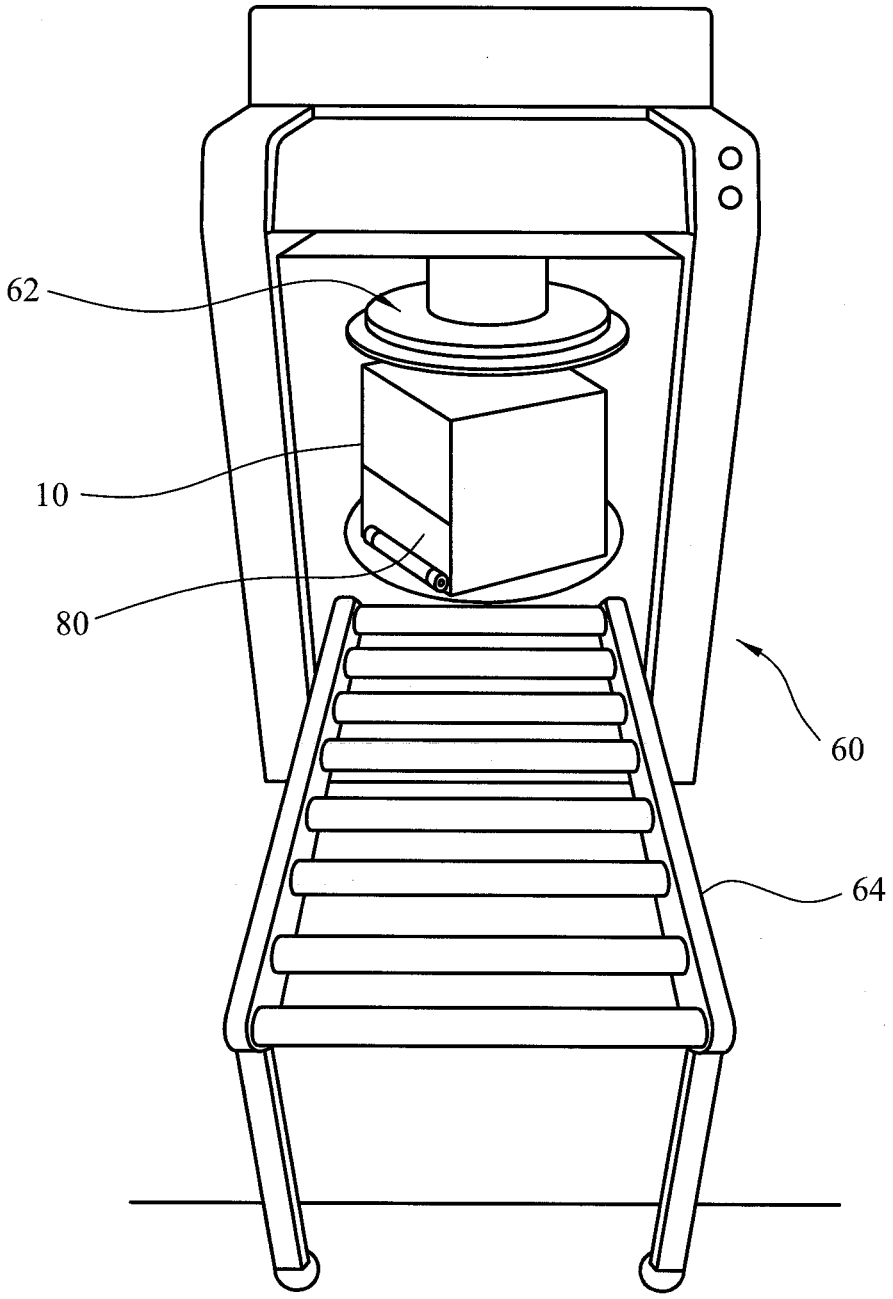
FIG. 5*a* is a front view of a mixing apparatus with a receptacle to be mixed in position.
Figure 5B:
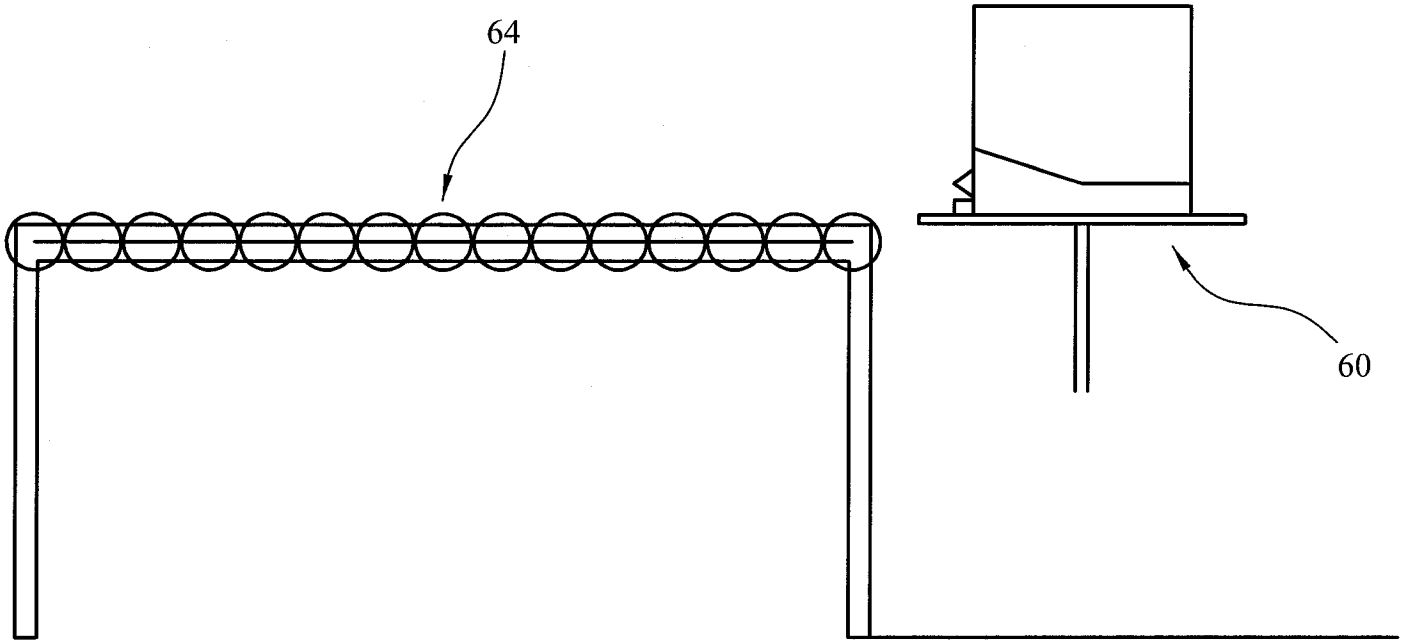
FIG. 5*b* is a schematic side view of the mixing apparatus.
Figure 5C:
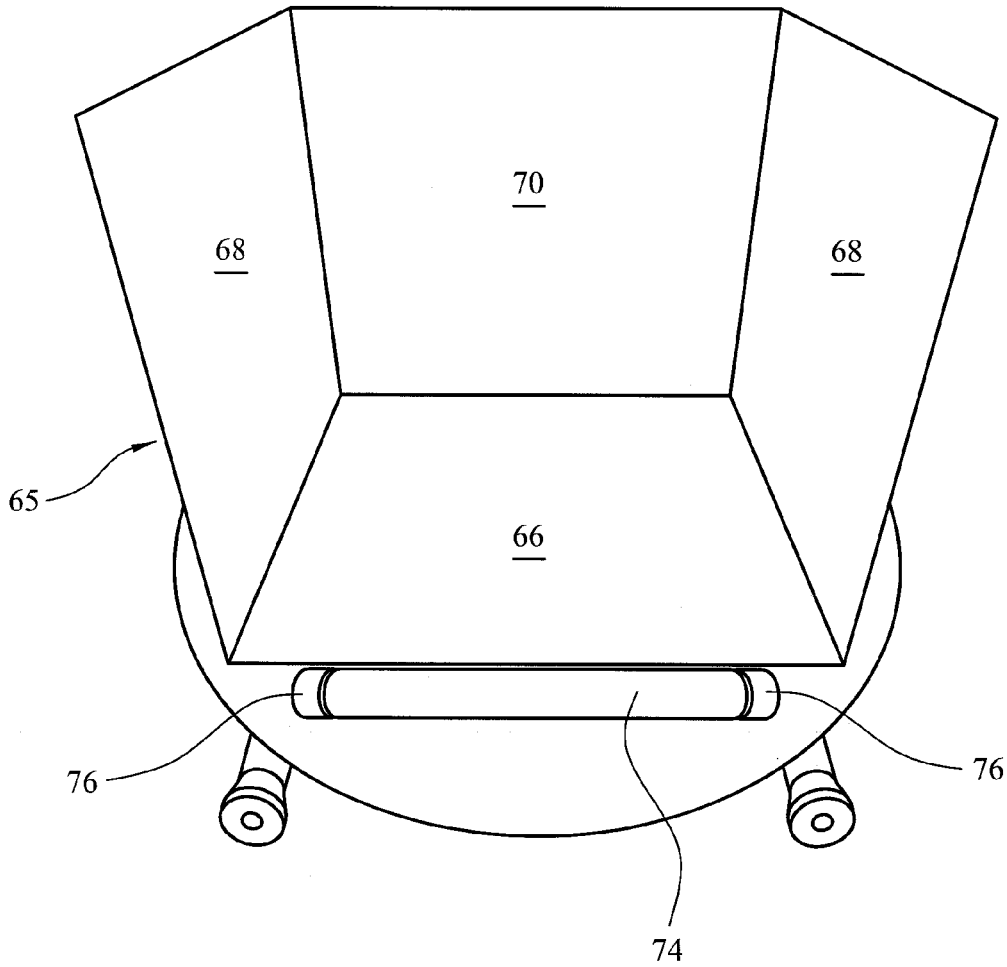
FIG. 5*c* is a front view of a receptacle support.
Figure 5D:
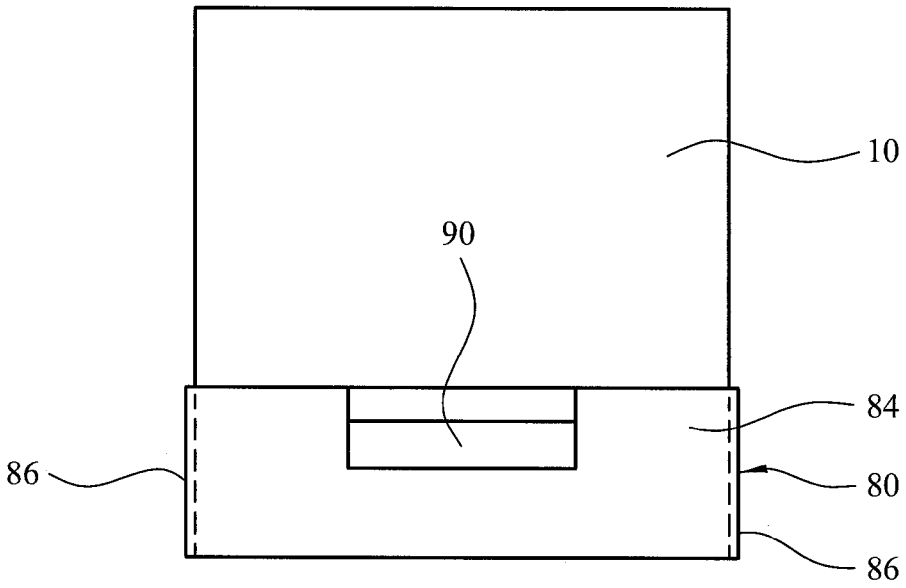
FIG. 5*d* is a front view of a tray for the receptacle, with the receptacle in position.
Figure 5E:
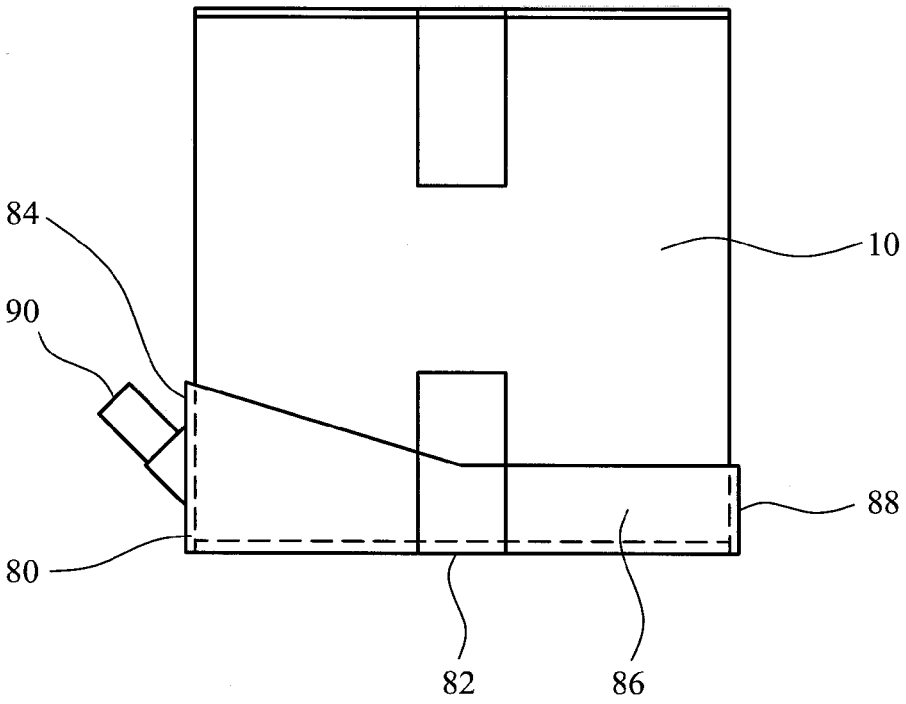
FIG. 5*e* is a side view, partly in cross-section of the tray with the receptacle in position.
Figure 5F:
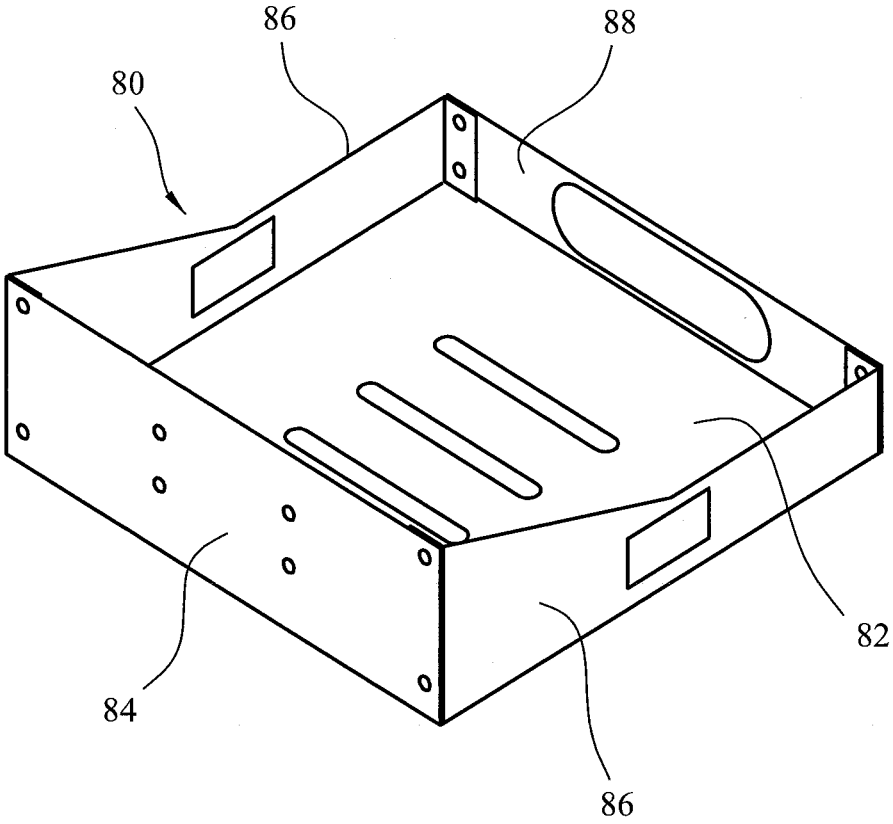
FIG. 5*f* is a perspective view of the tray with the receptacle omitted.
Figure 5G:
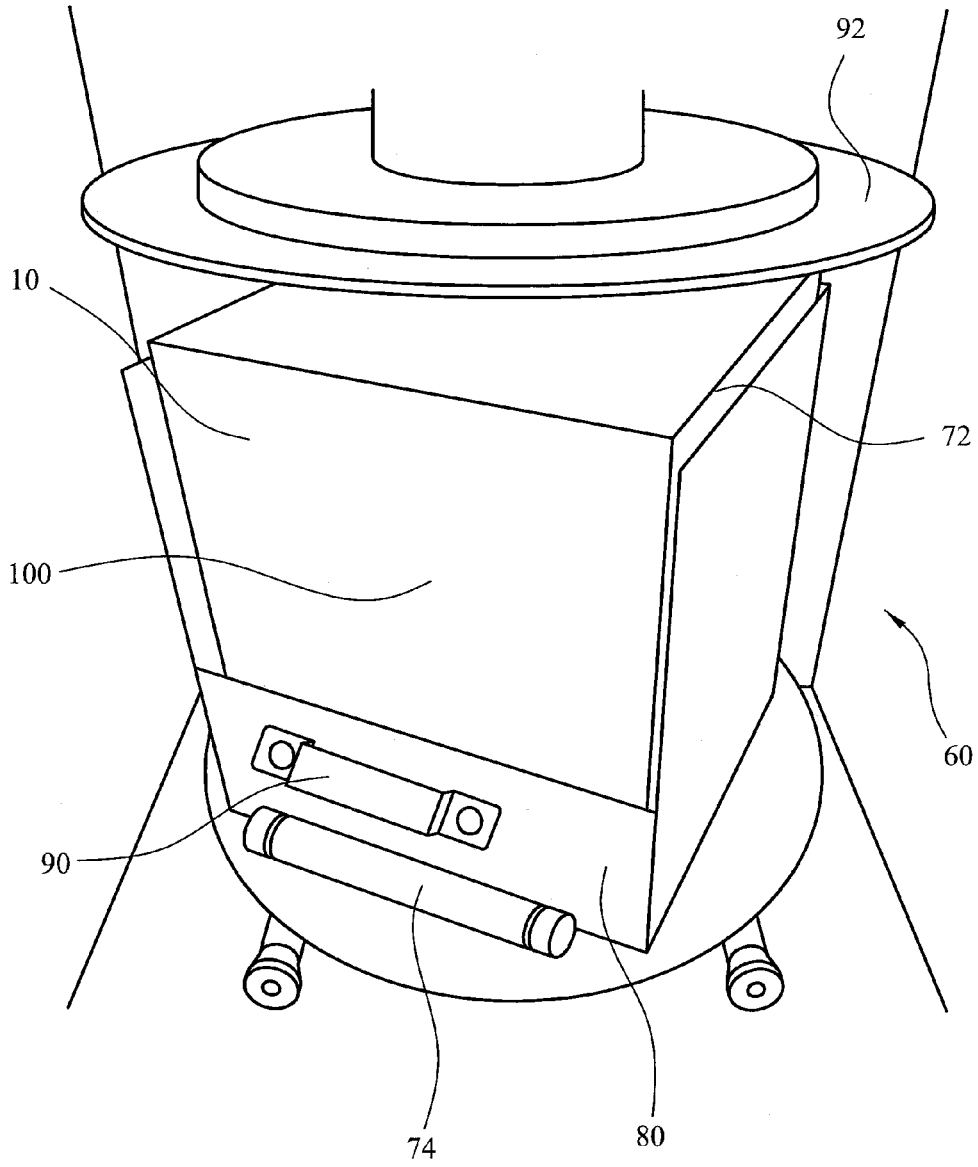
FIG. 5*g* is a perspective view of part of the mixing apparatus prior to clamping of the receptacle in position.

The support assembly for the receptacle is completed by a clamp plate 92 which is arranged to move downwardly from its FIG. 5*g* position to a position wherein it clamps down on top region 72 of receptacle 10. When so disposed, the receptacle 10 is substantially immovably secured in position, whilst avoiding application of any force which may significantly damage the cardboard box 40 of the receptacle. Furthermore, it will be appreciated that the receptacle is covered, at least to some extent, on all sides by a supporting wall (e.g. 66, 68, 70, 84) and is completely covered on all sides by a supporting wall, except for an exposed front region 100 of the box. The highly supportive structure is found to minimise damage to the cardboard of receptacle 10 during mixing and yet provides a quick means of introducing and removing the receptacle from the mixing apparatus.

Figure 6:
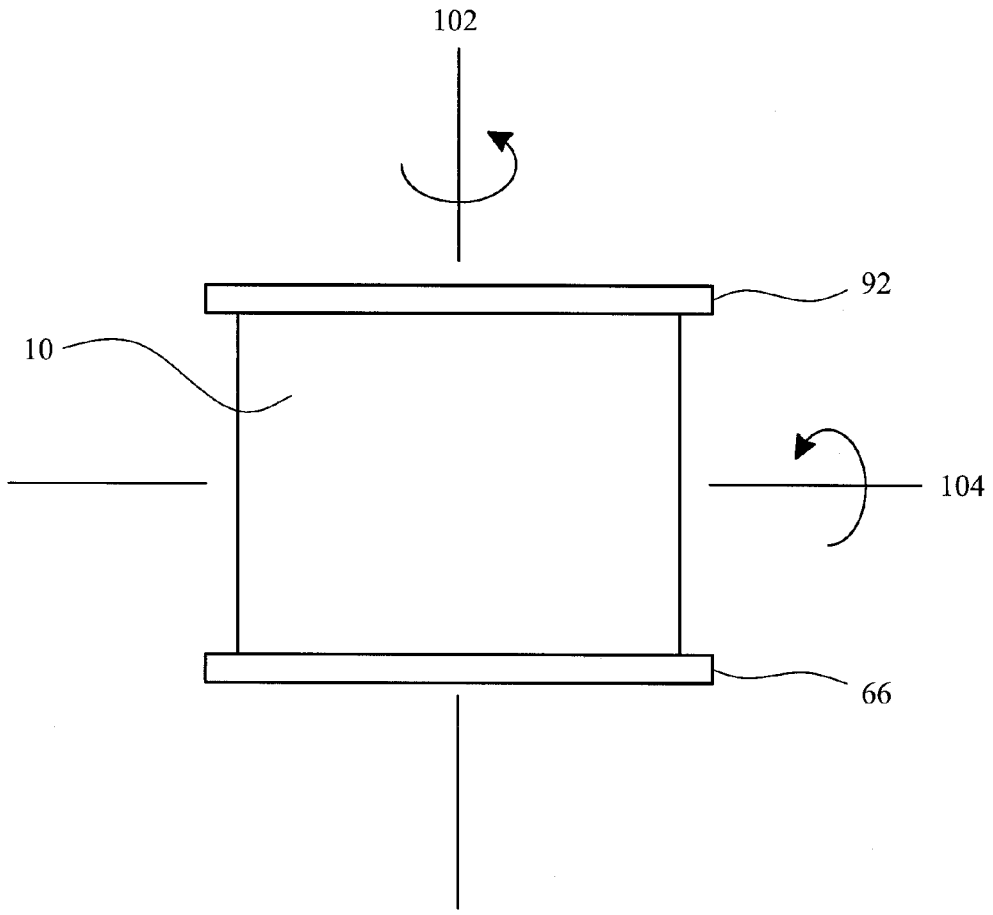
FIG. 6 is a schematic representation of gyroscopic mixing of the receptacle.

The mixing apparatus is arranged to subject the receptacle 10 to gyroscopic mixing. More particularly, the receptacle is supported and arranged to be rotated about two orthogonal axes, as represented in FIG. 6—vertical axis 102 and horizontal axis 104. The rpm about the two axes may be in the range 90 to 190 rpm. Mixing may be undertaken for 1 to 4 minutes.

The apparatus described may be used and/or operated as follows:

The FIG. 1 apparatus is used to produce an unmixed formulation in receptacle 10 which comprises liner 14 secured within box 40. The box is taped closed. The receptacle 10 is engaged with tray 80 as described. The tray is placed on conveyor 64 and rolled manually towards the first support structure 65. It is then rolled over roller 74 and slid into structure 65. Clamp plate 92 is then moved downwardly to securely clamp the receptacle 10 in position. Next, the gyroscopic mixer is operated for a time sufficient to completely mix the contents of the receptacle. Thereafter, the receptacle 10 is removed by an operator using handle 90 to pull the tray (and associated receptacle) onto and across roller 74 and onto the conveyor 64. The receptacle can then be removed to a storage location and/or transported to a customer.

It is found that the mixing process and handling of the receptacle advantageously does not significantly damage the liner 14 or box part 11. After mixing, the formulation in the receptacle is suitably homogenous and remains so for at least six months under normal storage conditions. The receptacle may be used by customers as required, for example to deliver a formulation into plastics processing apparatus. After use, the liner and box part can be separated and both readily recycled.

In an additional embodiment, the mixing process described herein may be used to re-mix older batches of formulations before use to ensure they are homogenous.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A receptacle comprising a cardboard box in which is arranged a plastics container, wherein a first securement element associated with the plastics container is positioned in a gap defined by the cardboard of the box thereby to restrict movement of the container within the box;

wherein said gap is defined, at least in part, between a first flap, a second flap and a third flap of the box, wherein said first flap and said first securement element make face to face contact, with said first flap overlying said first securement element;

wherein said second flap is positioned underneath the first securement element and a lower face of the first securement element makes face to face contact with an upper face of the second flap;

wherein said third flap extends substantially parallel to said second flap and said third flap is positioned underneath the first securement element, wherein a lower face of the first securement element makes face to face contact with an upper face of the third flap;

wherein said cardboard box includes a fourth flap which extends parallel to the first flap, wherein the fourth flap does not contact the first securement element and wherein the fourth flap overlies the second and third flaps.

2. A receptacle according to claim 1, wherein said first securement element is elongate and the width of the first securement element, measured in a direction perpendicular to the elongate extent thereof, is less than 25% of the length of the first securement element measured in the direction of the elongate extent.

3. A receptacle according to claim 1, wherein said first securement element is an integral part of said plastics container and is positioned outside a part of said container which contains fluid in use.

4. A receptacle according to claim 1, wherein said first securement element defines an elongate male element which is positioned in said gap and extends at least 50% along the length of a first side of the container.

5. A receptacle according to claim 1, wherein said first securement element has a maximum thickness in the range 1 to 4 mm, a maximum length in the range 15 to 50 cm and a maximum width in the range 20 to 50 mm.

6. A receptacle according to claim 1, wherein said first flap is pivotable between open and closed positions during opening and/or closing and/or assembly of the box.

7. A receptacle according to claim 6, wherein said second flap is pivotable between open and closed positions during opening and/or closing and/or assembly of the box.

8. A receptacle according to claim 7, wherein said third flap is pivotable between open and closed positions during opening and/or closing and/or assembly of the box.

9. A receptacle according to claim 1, wherein a second securement element is associated with said plastics container and is positioned in a second gap defined by the cardboard of the box thereby to provide a further means in addition to said first securement element of restricting movement of the container within the box, wherein said second securement element is spaced from said first securement element, said first and second securement elements extend substantially parallel to one another and said first and second securement elements are diagonally opposite one another.

10. A receptacle according to claim 9, wherein said second securement element is positioned outside a part of said container which contains fluid in the use, is a component of a unitary moulding which includes at least a part of said container which contains fluid in use and has a maximum thickness in the range 1 to 4 mm, a maximum length in the range 15 to 50 cm; and a maximum width in the range 20 to 50 mm.

11. A receptacle according to claim 9, wherein said second gap is defined, at least in part, by a fifth flap of the box, wherein said fifth flap is pivotable between open and closed positions during opening and/or closing and/or assembly of the box, wherein said fifth flap and said second securement element make face to face contact; and said second gap is defined, at least in part, between said fifth flap and a sixth flap of the box, wherein said sixth flap is pivotable between open and closed positions during opening and/or closing and/or assembly of the box; and said second gap is defined, at least in part, between said fifth flap, said sixth flap, and a seventh flap of the box, wherein said seventh flap is pivotable between open and closed positions during opening and/or closing and/or assembly of the box, wherein the second securement element is positioned between and/or makes face to face contact with said fifth flap, said sixth flap and said seventh flap.

12. A receptacle according to claim 9, wherein tape is applied to the cardboard box to facilitate retention of the first and second securement elements in said respective gaps.

13. A receptacle according to claim 1, wherein said plastics container is not self-supporting and/or is collapsible.

14. A receptacle according to claim 1, wherein said plastics container contains a liquid formulation which includes a colourant, wherein said liquid formulation is for addition to a plastics material in the manufacture of a plastics part, wherein said liquid formulation has a viscosity, measured using a Brookfield Viscometer at 2 rpm and 23° C., of greater than 100 cP.

15. A receptacle according to claim 1, wherein a second securement element is associated with said plastics container and is positioned in a second gap defined by the cardboard of the box thereby to provide a further means in addition to said first securement element of restricting movement of the container within the box, wherein said first and second securement elements extend substantially parallel to one another and are diagonally opposite one another.

16. A receptacle according to claim 15, wherein said second gap is defined, at least in part, by a fifth flap of the box, wherein said fifth flap is pivotable between open and closed positions during opening and/or closing and/or assembly of the box; and wherein said second gap is defined, at least in part, between said fifth flap and a sixth flap of the box, wherein said sixth flap is pivotable between open and closed positions during opening and/or closing and/or assembly of the box and wherein said box includes an eighth flap which extends parallel to the fifth flap and/or is pivotable about an axis defined on an opposite side of the box to that of the fifth flap.

17. A receptacle according to claim 1, wherein the ratio of the maximum width of the first flap to the maximum width of said first securement element is in the range 1.5 to 5.

18. A receptacle according to claim 1, wherein said plastics container includes a first opening for passage of liquid from the container, wherein said first opening has a circular cross-section and is provided with a closure which is releasably securable for closing the opening.

* * * * *